US008052542B1

(12) United States Patent
Cepin

(10) Patent No.: US 8,052,542 B1
(45) Date of Patent: Nov. 8, 2011

(54) GOLF BALL RETRIEVER

(76) Inventor: George Cepin, Youngstown, OH (US)

( * ) Notice: Subject to any disclaimer, the term of this patent is extended or adjusted under 35 U.S.C. 154(b) by 128 days.

(21) Appl. No.: 12/584,853

(22) Filed: Sep. 14, 2009

(51) Int. Cl.
*A63B 47/02* (2006.01)

(52) U.S. Cl. ..... 473/286; 294/19.2

(58) Field of Classification Search ..... 473/286; 294/19.2

See application file for complete search history.

(56) References Cited

U.S. PATENT DOCUMENTS

| | | | | |
|---|---|---|---|---|
| 2,057,821 | A * | 10/1936 | Costello | 473/235 |
| 3,058,767 | A | 10/1962 | Baker | |
| 3,749,407 | A | 7/1973 | Prochnow | |
| 3,997,169 | A * | 12/1976 | Bergstrom | 473/286 |
| 5,112,093 | A | 5/1992 | Kindling | |
| D388,850 | S | 1/1998 | Ranger | |
| 6,077,170 | A | 6/2000 | Hawkins | |
| 6,159,108 | A * | 12/2000 | de la Pena | 473/286 |
| 7,118,489 | B1 * | 10/2006 | Hubley | 473/226 |
| 7,686,702 | B2 * | 3/2010 | Hubley | 473/226 |
| 2002/0147055 | A1 * | 10/2002 | French | 473/286 |
| 2003/0036439 | A1 * | 2/2003 | O'Neill | 473/286 |
| 2004/0166955 | A1 | 8/2004 | Nadratowski et al. | |
| 2005/0170904 | A1 * | 8/2005 | Smeeth | 473/286 |

* cited by examiner

*Primary Examiner* — Stephen L. Blau
(74) *Attorney, Agent, or Firm* — Harpman & Harpman

(57) ABSTRACT

A ball retriever for use on golf balls by being selectively positioned on the head of a golf club iron. The ball retriever defines an open cup having contoured side walls with a cut-away area where for visibility during use. A powerful magnet is secured within the base of the cup providing magnetic attraction and selective positioning and removal attachment on to any ferrous metal club head face.

6 Claims, 2 Drawing Sheets

GOLF BALL RETRIEVER

BACKGROUND OF THE INVENTION

1. Technical Field

This invention relates to ball retrievers for golf balls where the ball is in a difficult-to-reach location, requiring the player to retrieve it therefrom.

2. Description of Prior Art

A number of golf ball engagement and retrieval devices have been developed to assist the player in retrieving their golf ball when positioned in areas of the course where direct hand engagement would be difficult. Such ball retrievers heretofore require a ball engagement portion and some sort of exterior handle. Other ball retrievers have been developed to attach directly to the golf club providing contact easily transportable and usable devices, see for example U.S. Pat. Nos. 3,058,767, 3,749,407, 5,112,093, 6,077,170, 388,850, and U.S. Patent 2004/0166955.

In U.S. Pat. No. 3,058,767 a golf ball retrieving device is disclosed having an initial cylindrical configuration with multiple slots and apertures therein that allow for deflection thereof so as to be positioned on the club head and retrieve a ball.

U.S. Pat. No. 3,749,407 claims a ball retriever attachment wherein a ball cup is suspended from a golf club head engagement clip.

U.S. Pat. No. 5,112,093 illustrates a golf ball retriever having a coil of high strength metal wire that will allow insertion on the club head with multiple coils extending therefrom into which the golf ball can be selectively secured during use.

U.S. Pat. No. 6,077,170 is directed to a golf ball retriever attachment having a depending ball cup from a club head receiving opening cited in closure configuration to the shape of the club head.

Patent D 388,850 defines an open bottom ball cup with an intricate extending clip that clips over the top edge of a golf club positioning the ball cup below the cup head for ball retrieval.

SUMMARY OF THE INVENTION

A golf ball retrieval device for a selective attachment to the golf club head by magnetic attraction. The ball retrieval device has a closed end cylindrical body with a cutaway side wall portion for vertical club face orientation on the club. A powerful magnet is secured within the cup providing for magnetic force attraction through the bottom while affording a oppositely disposed open end ball capture in a self-contained easily removable ball retrieval device.

DETAILED DESCRIPTION OF THE INVENTION

Figure 1:
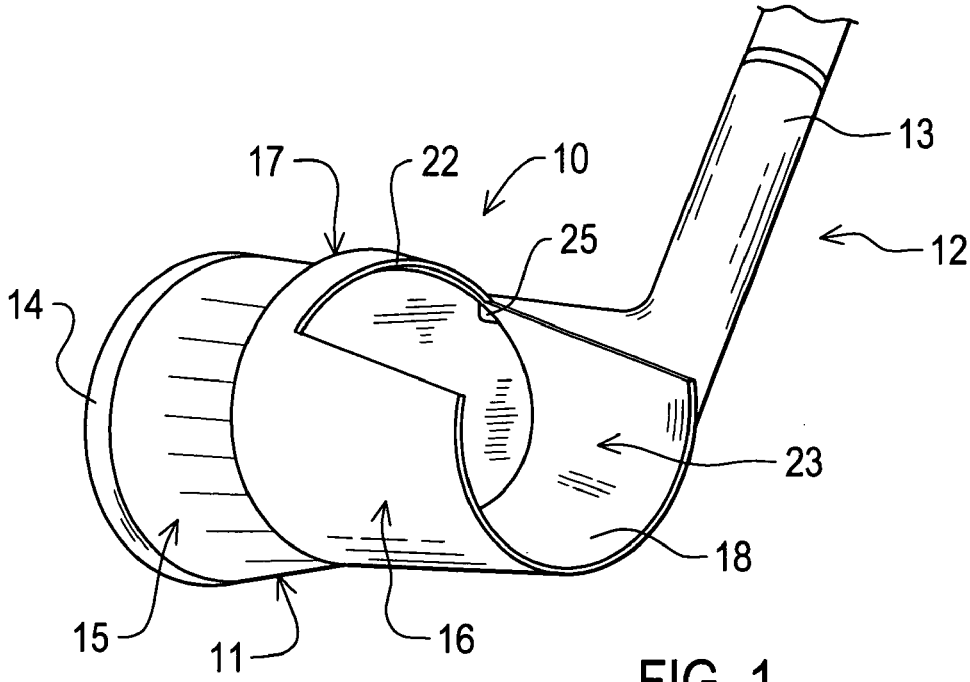
FIG. 1 is a perspective view of the golf ball retrieval attachment on the head of a golf club iron/
Figure 2:
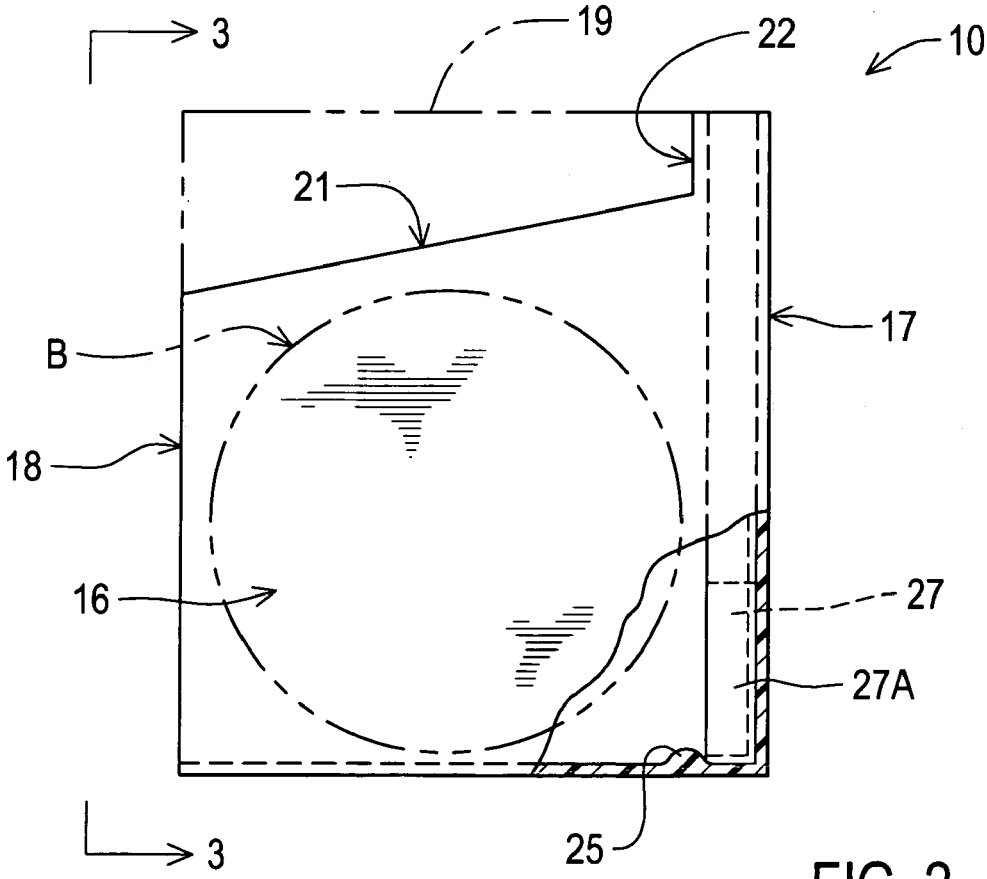
FIG. 2 is an enlarged side elevational view of the golf ball retrieval attachment.
Figure 3:
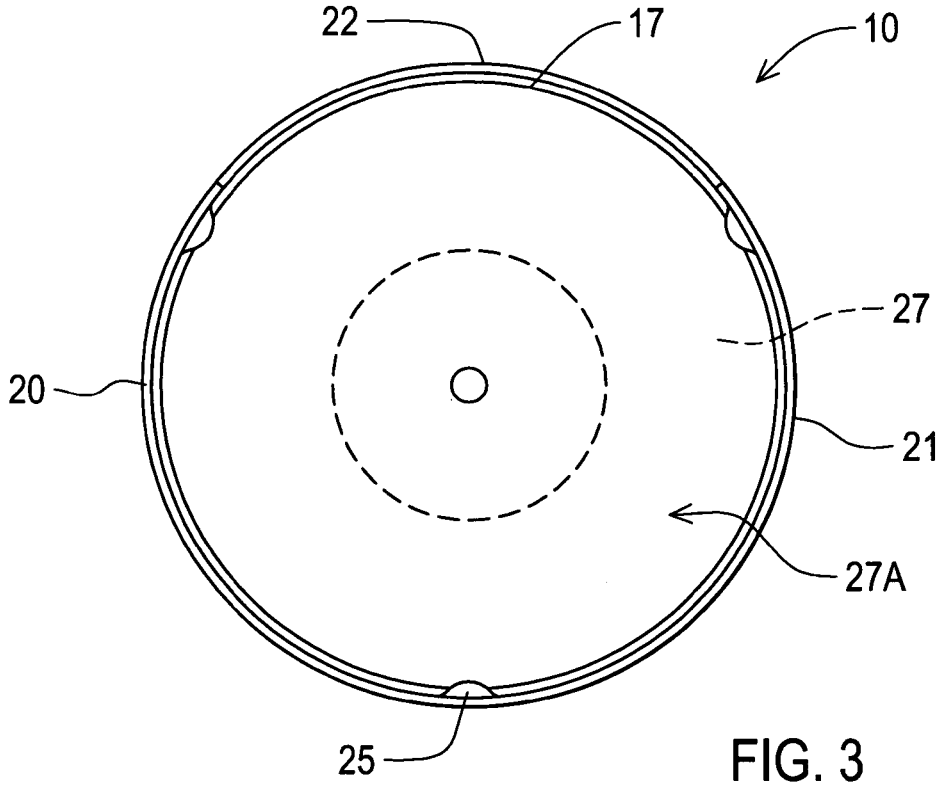
FIG. 3 is an enlarged front elevational view thereof.
Figure 4:
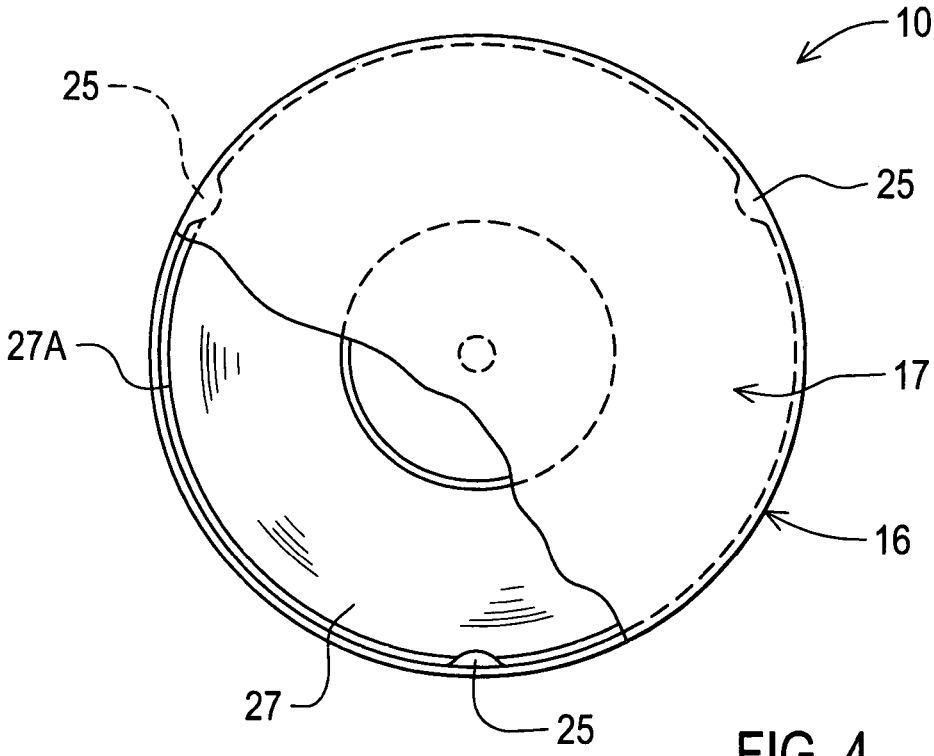
FIG. 4 is an enlarged rear elevational view thereof.

Referring to FIG. 1 of the drawings, a golf ball retrieval attachment 10 of the invention can be seen on a club head 11 of a golf club 12 with a club shaft 13. The club head 11 has a contoured base 14 with the club shaft 13 extending from an upper end portion as is typical and well-known within the art. The club head 11 has a flat club face 15 for striking a golf ball B shown in broken lines. The club head 11 is composed of ferrous metal and is commonly referred to as an iron. The golf ball retrieval attachment 10 of the invention has a cylindrical body member defined by a continuous annular side wall 16 best seen in FIGS. 2 and 3 of the drawings with an integrally closed end 17 and opposing open end 18.

An arcuate portion 19 shown in broken lines of the annular side wall 16 is cut away defining a pair of space parallel wall edges 20 and 21 interconnected by an arcuate wall edge 22. It will be noted that the arcuate wall edge 22 is in space-relation to the hereinbefore described closed end 17 forming an attachment receiving area 23 therewithin. In this example the respective parallel wall edges 20 and 21 are in angular relation to the corresponding oppositely disposed annular side wall surface 16.

A plurality of retaining tabs 25 extend inwardly from the interior of wall surface 16 in radially-spaced relation to one another and in space co-planar relation with the hereinbefore described end 17.

A permanent magnet 27 is provided positioned within a disk configured holder 27A which is of a registering diameter and thickness so as to be fitted into the receiving area 23 against the end 17 within the hereinbefore described cylindrical body member. The magnet assembly is retained by engagement of the multiple retainment tabs 25 by friction fit against the magnet's assembly upper surface 27A.

It will be seen that in use the golf ball retrieval attachment 10 is selectively attached to the club face 15 of the golf club head 11 by the magnetic force with the closed end 17 in an abutting relationship therewith as illustrated in FIG. 1 of the drawings.

Once so attached with the cutaway portion 19 of the annular wall 16 oriented to face upwardly, the golf ball B can be scooped up therewithin and retrieved. After use, given the nature of the magnetic attachment, the golf ball retainment attachment 10 can be easily removed from the club head 11 and the golf club used in play as needed.

It will thus be seen that a new and novel golf ball retainment attachment has been illustrated and described and be apparent to those skilled in the art that various changes and modifications may be made thereto without departing from the spirit of the invention.

Therefore I claim:

1. A golf ball retriever for use on the head of a golf club having a metallic ball striking face comprises, a molded synthetic resin cup having a flat bottom, an annular side wall extending from said body with an open ball receiving end, a cutaway portion of said side wall defining space parallel side wall edges, a magnet registerably secured within said cup against said bottom, and means for retaining said magnet within said cup.

2. The golf ball retriever of claim 1 wherein a remaining portion of said side wall between said cutaway side wall portion extending from said bottom forms a retainment lip for said magnet.

3. The golf ball retriever of claim 1 wherein said magnet establishes a strong magnetic attraction to said golf club metallic ball striking face through said cup bottom.

4. The golf ball retriever of claim 1 wherein said space parallel side wall edges are tapered outwardly from said bottom defining a ball viewing opening in said side wall portion when aligned facing upwardly on said club face.

5. The golf ball retriever of claim 1 wherein said cup is positioned on said golf club face to scoop up a ball for retrieval and then remove from said club face and transported independently thereof.

6. The golf ball retriever of claim 1 wherein said means for retaining said magnet within said cup against said cup bottom comprises, a plurality of annularly spaced tabs extending inwardly from said annular side wall.

* * * * *